US005474378A

United States Patent [19]

Smith et al.

[11] Patent Number: 5,474,378

[45] Date of Patent: Dec. 12, 1995

[54] ADJUSTABLE SUPPORT APPARATUS FOR A DISHRACK

[75] Inventors: John I. Smith, Hagar Township, Berrien County; Michael L. Giddings, Battle Creek, both of Mich.

[73] Assignee: Whirlpool Corporation, Benton Harbor, Mich.

[21] Appl. No.: 161,020

[22] Filed: Dec. 3, 1993

[51] Int. Cl.[6] ..... A47B 88/12

[52] U.S. Cl. ..... 312/334.4; 248/297.31

[58] Field of Search ..... 312/350, 334.4, 312/334.21, 323; 248/295.1, 297.2, 297.3

[56] References Cited

U.S. PATENT DOCUMENTS

| | | | |
|---|---|---|---|
| 3,560,069 | 2/1971 | Doepke . | |
| 3,726,580 | 4/1973 | Guth . | |
| 3,726,581 | 4/1973 | Doepke . | |
| 3,736,037 | 5/1973 | Doepke . | |
| 3,761,153 | 9/1973 | Guth . | |
| 3,768,883 | 10/1973 | Kauffman . | |
| 3,809,450 | 5/1974 | Guth . | |
| 3,809,451 | 5/1974 | Pitstick . | |
| 3,822,085 | 7/1974 | Clark . | |
| 3,892,453 | 7/1975 | Daily . | |
| 4,097,099 | 6/1978 | Spiegel . | |
| 4,226,490 | 10/1980 | Jenkins et al. . | |
| 4,449,765 | 5/1984 | Lampman . | |
| 5,044,666 | 9/1991 | Griesemer | 248/297.3 |

FOREIGN PATENT DOCUMENTS

| | | | |
|---|---|---|---|
| 0264052 | 8/1988 | Austria | 312/334.4 |

*Primary Examiner*—Kenneth J. Dorner
*Assistant Examiner*—Gerald A. Anderson
*Attorney, Agent, or Firm*—Robert O. Rice; Joel M. Van Winkle

[57] ABSTRACT

A manually adjustable support assembly for movably supporting an upper dishrack within a dishwasher. A plurality of support assemblies are provided for each dishrack and permit manual adjustments of the dishrack between predetermined vertically spaced positions. Each of the adjustable support assemblies comprise a housing for interconnection with the dishrack. A flex plate is disposed adjacent the housing and slidably interconnects with the housing. A wheel rotatably interconnects with the flex plate and is rotatably received into a track supported on the sidewall of the dishwasher tub. The flex plate includes a positioning rib which is received into one of a plurality of receiving slots formed into the housing. By flexing the flex plate, the positioning rib may be disengaged from one of the receiving slots and the flex plate moved longitudinally relative to the housing. By relaxing the flex plate, the positioning rib is engaged into the adjacent-most receiving slot. In this fashion, therefore, the dishrack may be moved between predetermined vertical positions.

14 Claims, 3 Drawing Sheets

ADJUSTABLE SUPPORT APPARATUS FOR A DISHRACK

BACKGROUND OF THE INVENTION

This invention relates to an adjustable dishrack support apparatus for a dishwasher in which improved means are provided for supporting each side of the dishrack and for vertically adjusting the support apparatus relative to the dishrack to accommodate articles of varying heights in the dishwasher.

In a typical front-loading dishwasher, there is provided an upper dishrack which is moveable in and out of the interior of the dishwasher tub in order to enable loading of dishware items into the dishrack. In a conventional form of a dishwasher, the dishrack is provided with simple support wheel assemblies disposed on opposite sides of the dishrack for rolling on a track provided on the sidewall of the dishwasher tub such that the dishrack is supported for movement in and out of the dishwasher tub. Typically, the simple support assemblies provided for dishracks do not allow for vertical height adjustments of the dishrack. Examples of these common non-adjustable dishrack support assemblies are clearly shown in U.S. Pat. Nos. 4,449,765 and 4,226,490.

The conventional non-adjustable support assemblies are generally adequate for the average load of dishes. There are times, however, when it is desirable to place unusually large items within the wash chamber. Often the space between the lower and upper rack in the typical front-opening dishwasher is not sufficient to enable loading and washing of large platters or cookie sheets, etc., in the preferred on-edge position therein. Moreover, space between the upper rack and the top of the wash chamber is not adequate to permit the placing of tall glasses or long-stemmed crystal ware within the upper rack.

Many complicated systems, therefore, have been developed to provide a dishrack vertical height adjustment feature in combination with the slidable support means of the upper dishrack in a front opening dishwasher. These adjustable dishrack support assemblies may be of a first type providing infinite height adjustment of the dishrack within a given range. U.S. Pat. Nos. 3,822,085 and 4,097,099 disclose examples of this first type of adjustable dishrack support assembly. Additionally, adjustable dishrack support assemblies may be of a second type providing height adjustment between a predetermined number of positions. Frequently these second types of adjustable support assemblies allow the dishrack to be adjusted between an upper position and a lower position. U.S. Pat. Nos. 3,726,580, 3,736,037 and 3,560,069 disclose examples of this second type of adjustable dishrack support assembly.

These prior art adjustable support assemblies, however, all contain disadvantages and drawbacks. In particular, these prior art attempts are relatively complicated assemblies, typically requiring large metallic elements, spring elements and additional wiring welded onto the dishrack. Furthermore, the second type of prior art adjustable support assemblies, as described above, typically do not allow for easy operator access from the top of the dishrack. Rather, these prior art assemblies typically require reaching beneath the dishrack to operate the adjustable mechanisms.

SUMMARY OF THE INVENTION

Accordingly, it is a primary object of the present invention to provide an improved rack arrangement for a front opening dishwasher cabinet that not only incorporates a minimum number of relatively simple mechanical parts but makes possible a quick height adjustment of a dishwasher rack between predetermined levels, regardless of whether the rack is empty or loaded with dishes when the adjustment is made.

It is a further object of the present invention to provide a manual height adjustment means for a dish supporting rack in an automatic dishwasher that may be relatively inexpensively produced for installation in a front loading dishwasher wherein the dish supporting racks are slidably mounted for manual outward movement to facilitate loading and unloading of soiled tableware therein.

It is also an object of this invention to provide a manually operated height adjustment means for a dish supporting rack that may allow for easy operator access from the top of the dishrack and that can be manipulated to raise one end or one side of the rack without changing the level of the respective other end or side thereof.

According to the present invention, the foregoing and other objects are attained by a manually adjustable support assembly for movably supporting an upper dishrack within a dishwasher. A plurality of support assemblies are provided for each dishrack and permit manual adjustments of the dishrack between predetermined vertically spaced positions. Each of the adjustable support assemblies comprise a housing for interconnection with the dishrack. A flex plate is disposed adjacent the housing and slidably interconnects with the housing. A wheel rotatably interconnects with the flex plate and is rotatably received into a track supported on the sidewall of the dishwasher tub. The flex plate includes a positioning rib which is received into one of a plurality of receiving slots formed into the housing. By flexing the flex plate, the positioning rib may be disengaged from one of the receiving slots and the flex plate moved longitudinally relative to the housing. By relaxing the flex plate, the positioning rib is engaged into the adjacent-most receiving slot. In this fashion, therefore, the dishrack may be moved between predetermined vertical positions.

DESCRIPTION OF THE PREFERRED EMBODIMENTS

Figure 1:
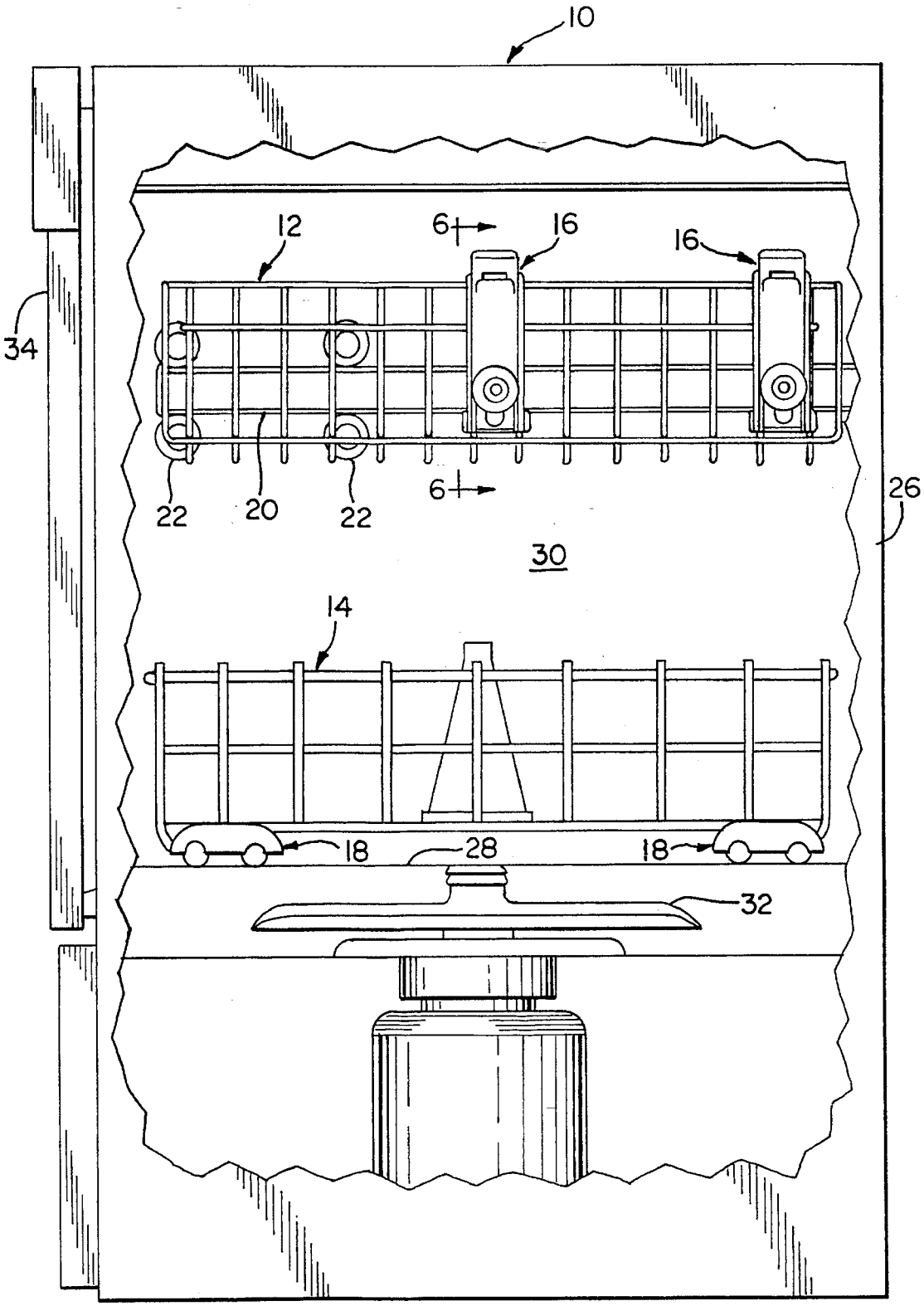
FIG. 1 is a partially sectional side elevational view of a dishwasher incorporating a dishwasher rack provided with adjustable support assemblies according to the present invention.

In the illustrative embodiment of the invention as disclosed in the drawing, a dishwasher generally designated 10 is provided with an upper dishrack 12 and a lower dishrack 14. The upper dishrack 12 is provided at opposite sides with at least two adjustable support assemblies per side generally designated 16 and the lower rack 14 is provided at its opposite sides with at least two wheel assemblies per side generally designated 18.

The adjustable support assemblies 16 are received in tracks 20 longitudinally movable between pairs of rollers 22 carried by the sidewall 24 of the dishwasher tub 26, as is well known. The lower wheel assemblies 18 roll on suitable track surfaces 28 provided on the sidewalls 24 of the tub 26.

As seen in FIG. 1, the tub 26 defines a dishwashing space 30, in which racks 12 and 14 are movably mounted, with spray means 32 provided for spraying dishwashing liquid upwardly against dishes and the like placed in the racks 12 and 14, respectively. Access to dishwashing space 30 is controlled by a closure door 34 hingedly mounted to the tub 26 to swing downwardly to an open position, wherein the dishracks may be rolled outwardly as for loading and the like.

Figure 2:
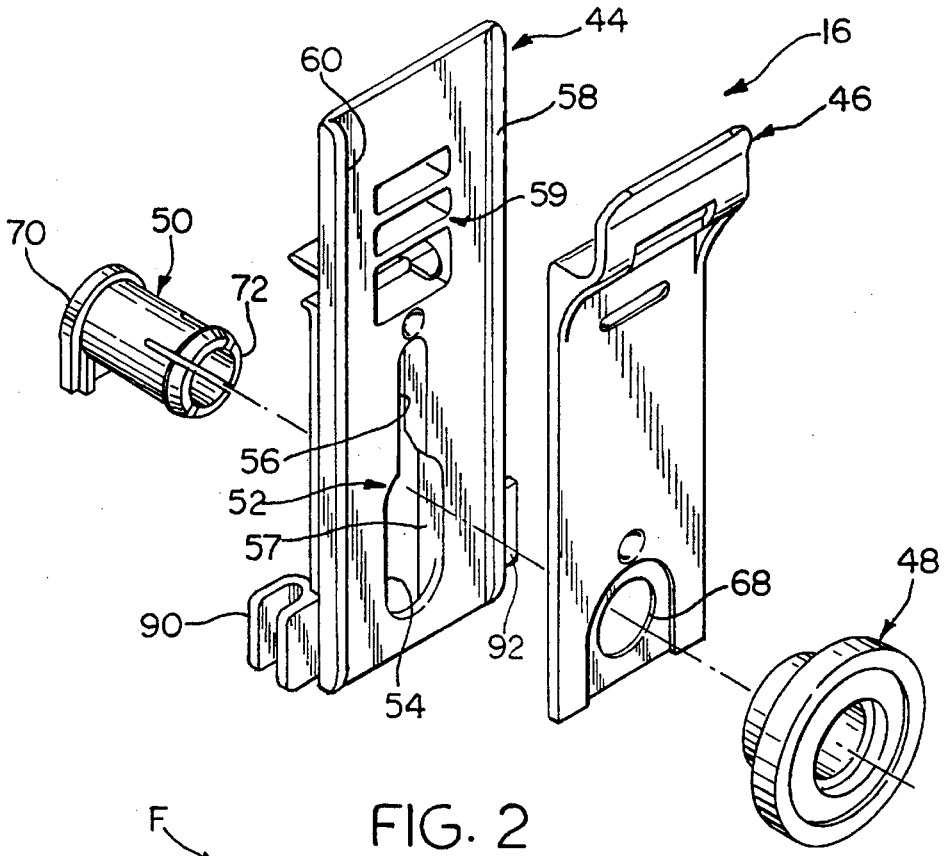
FIG. 2 is an exploded perspective view of the components for the adjustable support assembly according to the preferred embodiment of the present invention.
Figure 3:
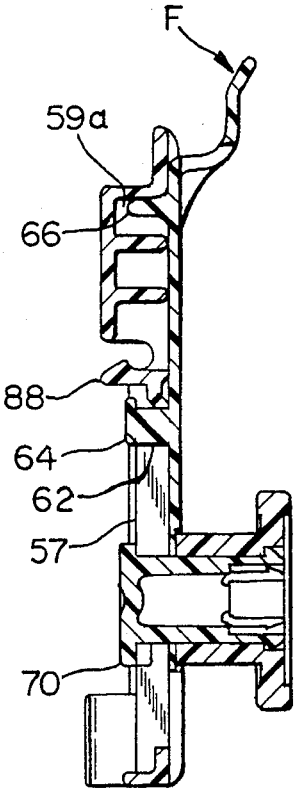
FIG. 3 is a sectional view of the adjustable support assembly wherein the flex plate is positioned in an uppermost position.
Figure 4:
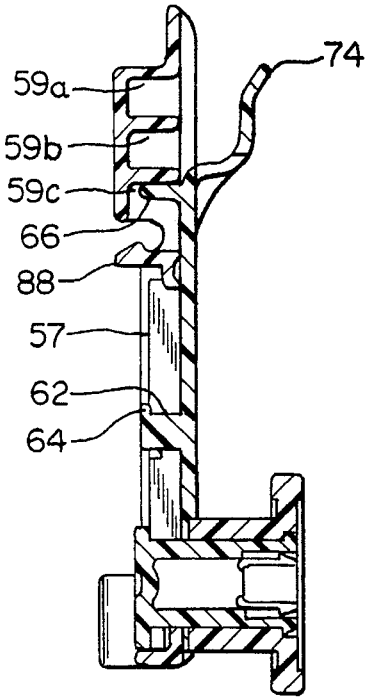
FIG. 4 is a sectional view of the adjustable support assembly wherein the flex plate is positioned in a lowermost position.

Each of the adjustable support assemblies 16 of the present invention is similar and is disclosed in greater detail in FIGS. 2–4. Each adjustable support assembly 16 includes a housing 44, a flex plate 46, a wheel 48 and an axle pin 50.

The housing 44 includes an elongated guide slot 52 having a lower widened portion 54 and an upper narrowed portion 56. Ribs 57 are disposed on the peripheral edge of the guide slot 52. A plurality of receiving slots 59 are formed into the housing 44 above the guide slot 52. The housing 44 further includes a pair of longitudinally extending ribs 58 and 60.

The flex plate 46 is disposed adjacent the housing 44, between the longitudinally extending ribs 58 and 60, and slidably interconnects with the housing 44. As shown, the flex plate is provided with a slot follower which includes a rib 62 having an enlarged head 64 extends from the middle portion the of back surface of the flex plate 46. The rib 62 and the enlarged head 64 are configured such that the enlarged head 64 extends through the guide slot 52. The enlarged head 64 is sized to be insertable into the widened portion 54 of the guide slot 52 but to be greater in width than the upper narrowed portion 56. In this fashion, therefore, the flex plate 46 may move longitudinally along the housing 44, between the longitudinally extending ribs 58 and 60, while the rib 62 rides within the guide slot 52 and the enlarged head 64 rides along ribs 57, engaging the flex plate 46 with the housing 44. A positioning rib 66 also extends from the upper portion of the back surface of the flex plate and is received into one of the plurality of receiving slots 59 when the flex plate 46 is disposed adjacent the housing 44.

The axle pin 50 is provided for insertion through the widened portion 54 of the guide slot 52 and a hole 68 formed into the lower portion of the flex plate 46. When inserted, a flanged end 70 of the axle pin 50 abuts the ribs 57 while a snap retention means 72, disposed opposite the flanged end 70, rotatably interlocks with the wheel 48. In this fashion, the axle pin 50 and wheel 48 serve to interconnect the flex plate 46 and the housing 44 in combination with the enlarged head 64. Furthermore, the position of the hole 68 on the lower portion of the flex plate 46 is such that longitudinally moving the flex plate 46 along the housing 44 causes the shaft of the axle pin 50 to move within the widened portion 54 of the guide slot 52 and the rib 62 to move within the narrowed portion 56. Interference between the shaft of the axle pin 50 and the bottom surface of the widened portion 54 of the guide slot 52 maintains the rib 62 within the narrowed portion 56 of the guide slot 52 such that the enlarged head 64 cannot travel below the narrowed portion 56 of the guide slot 52.

The flex plate 46 is manually adjustable between predetermined vertically spaced portions in the following manner. When the adjustable support assemblies are assembled together, the positioning rib 66 is received into one of the plurality of receiving slots 59 for controlling the vertical position of the flex plate 46 relative to the housing 44. As shown in FIG. 4, the positioning rib 66 is disposed in the uppermost receiving slot. By exerting a force F on a handle 74, extending from the top portion of the flex plate 46, the body of the flex plate 46 may be flexed such that the positioning rib 66 disengages from the receiving slot 59 wherein the flex plate 46 may be moved longitudinally relatively to the housing 44. Removing the force F causes the position rib 66 to engage the adjacent receiving slot 59. In this fashion, it can be understood by one skilled in the art that for the disclosed embodiment, the flex plate 46 may be positioned in any one of three receiving slots 59 corresponding to three predetermined vertically spaced positions. The present invention, however, is not limited to three receiving slots 59, but may be configured to include any number of receiving slots of two or more.

Figure 5:
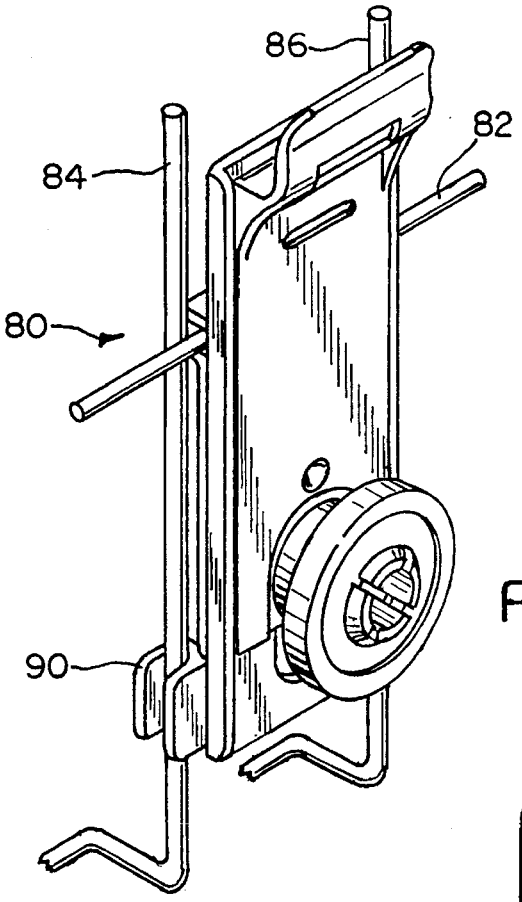
FIG. 5 is a perspective view of the adjustable wheel assembly of the present invention assembled to the dishrack.
Figure 6:
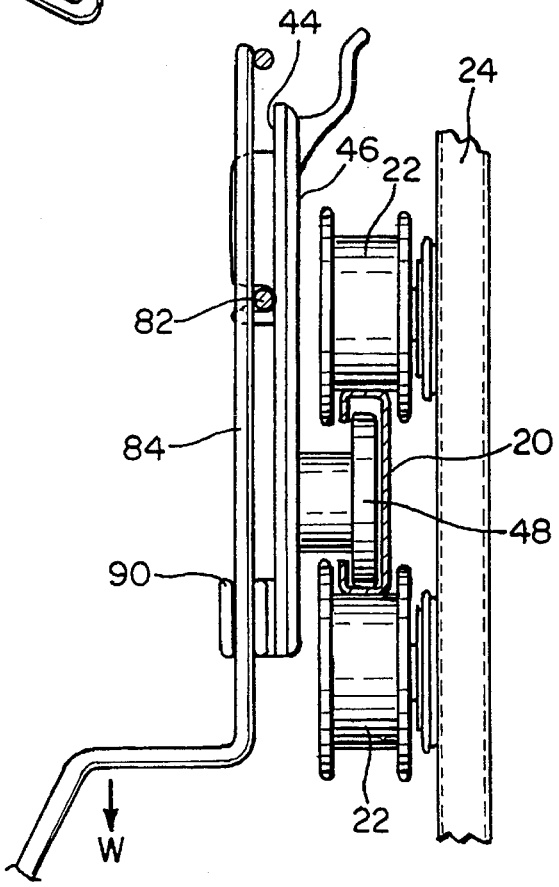
FIG. 6 is an enlarged view taken along lines 6—6 of FIG. 1.

The interconnection of the upper dishrack 12 and one of the adjustable support assemblies 16 is shown in greater detail in FIGS. 5 and 6. As seen in FIG. 5, the dishrack 12 includes a support means 80 including a top, horizontally elongated element 82 which extends generally parallel to the track 20. Support 80 further includes a pair of downwardly directed spaced side elements 84 and 86, extending generally perpendicular to the horizontally elongated element 82. Each adjustable support assembly 16 includes an upper snap retention member 88 (FIGS. 3 and 4), extending from the housing 44, for snapping onto the top element 82. The upper snap retention member vertically positions the adjustable support assembly 16 and prevents the adjustable support assembly 16 from sliding upwardly along the side element 84 and 86 under a loaded rack condition. Opposed side hooks 90 and 92 are provided for capturing the side elements 84 and 86 for preventing the adjustable support assembly 16 from rotating about the top element 82.

In this fashion, therefore, the adjustable support assemblies 16 support the dishrack 12. As shown in FIG. 6, the wheel 48 is received into the track 20 such that the dishrack 12 may be movably supported within the dishwasher. The dishrack 12 and any items loaded therein, illustrated as weight W, is supported by the adjustable support assemblies 16. Specifically, for each adjustable support assembly 16, the dishrack load W is transferred through the flex plate 46, axle pin 50 and finally the wheel 48, such that the rollers 22, being rotatably mounted to the dishrack sidewall 24, support the weight of the dishrack 12. This loading configuration, forces the positioning rib 66 upwardly against upper surfaces 59*a*, 59*b* and 59*c* of the receiving slots 59.

Although the present invention has been described with reference to a specific embodiment, those of skill in the art will recognize that changes may be thereto without departing from the scope and spirit of the invention as set forth in the appended claims.

We claim:

1. An adjustable support assembly in combination with a dishwasher having a tub defining outer sidewalls at opposite sides of a dishwashing space within a cabinet, horizontal tracks on the sidewalls, and a dishrack, wherein a plurality of said manually adjustable support assemblies are provided for permitting manual adjustments of the dishrack between predetermined vertically spaced positions and for moveably carrying said dishrack on the sidewall tracks for movement into and from the dishwashing space, said adjustable support assembly comprising:

a housing interconnected to said dishrack;

a flex plate slidably interconnected with said housing;

manual adjustment means for engaging said flex plate with said housing at a predetermined number of positions; and a wheel rotatably interconnected with said flex plate, said wheel carried in one of said horizontal tracks on the sidewalls; wherein manual adjustment of said flex plate between said predetermined number of positions moves said dishrack between said predetermined vertically spaced positions.

2. An adjustable support assembly according to claim 1 wherein said flex plate is an elongated member having a handle portion extending from an upper end of said flex plate.

3. The adjustable support assembly according to claim 1 further comprising:

a plurality of receiving slots formed in said housing; and a positioning rib extending from said flex plate for engaging said receiving slots.

4. The adjustable support assembly according to claim 1 wherein said flex plate includes an opening extending through said flex plate and said adjustable support assembly further comprises:

an axle pin extending through said opening of said flex plate and interconnected to said wheel such that said wheel is rotatably supported on said axle pin adjacent said flex plate.

5. The adjustable support assembly according to claim 4 wherein:

said housing includes an elongated slot having a widened portion and a narrowed portion;

said flex plate includes a slot follower for engaging said elongated slot, said slot follower including a base portion extending from said flex plate and a widened head portion disposed on a terminal end of the base portion such that said widened head portion may extend through said widened portion of said elongated slot wherein subsequent relative motion between said housing and said flex plate causes said base portion to ride within said narrowed portion of said elongated slot.

6. The adjustable support assembly according to claim 5 wherein said axle pin further comprises:

a bearing shaft portion;

a snap retention means at one end of said shaft portion; and a flanged end having a width greater than said widened portion of elongated slot at an opposite end of said shaft portion; wherein said axle pin extends through said widened portion of said elongated slot of said housing and said opening of said flex plate and snaps into said wheel such that said wheel is rotatably supported adjacent to said flex plate by said snap engagement means and said flanged end of said axle pin slidably secures said flex plate in a slideable relationship to said housing.

7. The adjustable support assembly according to claim 3 wherein said positioning rib extending from said flex plate for engaging into said receiving slots is disposed on said flex plate a predetermined distance from said slot follower to allow said flex plate to be flexed such that said positioning rib may be disengaged from said receiving slots to allow adjustment of said dishrack between said predetermined vertically spaced positions.

8. The adjustable support assembly according to claim 7 wherein housing includes three of said receiving slots.

9. An adjustable support assembly in combination with a dishwasher having a tub defining outer sidewalls at opposite sides of a dishwashing space within the cabinet, horizontal tracks on the sidewalls, and a dishrack, wherein a plurality of said manually adjustable support assemblies are provided for permitting manual adjustments of the dishrack between predetermined vertically spaced positions and for moveably carrying said dishrack on the sidewall tracks for movement into and from the dishwashing space, said adjustable support assembly comprising:

a housing interconnected to said dishrack, said housing having a plurality of receiving slots formed therein;

a flex plate slidably interconnected with said housing;

a positioning rib extending from said flex plate for engaging into one of said receiving slots such that said flex plate may be moved longitudinally relative to said housing between predetermined vertically spaced positions; and a wheel rotatably interconnected with said flex plate, said wheel insertable into said horizontal tracks on the sidewalls; wherein manual adjustment of said flex plate between said predetermined number of positions causes said dishrack to move between said predetermined vertically spaced positions.

10. The adjustable support assembly according to claim 9 wherein said flex plate is an elongated member having a handle portion extending from an upper end of said flex plate.

11. The adjustable support assembly according to claim 9 wherein:

said housing includes an elongated slot having a widened portion and a narrowed portion;

said flex plate forms a slot follower for engaging said elongated slot, said slot follower including a base portion extending from said flex plate and a widened head portion disposed on the terminal end of the base portion such that said widened head portion may extend through said widened portion of said elongated slot wherein subsequent relative motion between said housing and said flex plate causes said base portion to ride within said narrowed portion of said elongated slot;

a wall of said flex plate forms an opening therethrough; and an axle pin extends through said opening of said flex plate and interconnects with said wheel such that said wheel is rotatably supported on said axle pin adjacent said flex plate.

12. The adjustable support assembly according to claim 11 wherein said axle pin further comprises:

a bearing shaft portion;

a snap retention means at one end of said shaft portion; and a flanged end having a width greater than said widened portion of elongated slot at an opposite end of said shaft portion; wherein said axle pin extends through said widened portion of said elongated slot of said housing and said opening of said flex plate and snaps into said wheel such that said wheel is rotatably supported adjacent to said flex plate by said snap engagement means and said flanged end of said axle pin slidably secures said flex plate in a slideable relationship to said housing.

13. The adjustable support assembly according to claim 11 wherein said positioning rib extending from said flex plate for engaging into said receiving slots is disposed on said flex plate a predetermined distance from said slot follower to allow said flex plate to be flexed such that said positioning rib may be disengaged from said receiving slots to allow adjustment of said dishrack between said predetermined vertically spaced positions.

14. The adjustable support assembly according to claim 13 wherein housing includes three of said receiving slots.

* * * * *